United States Patent [19]

Stadler et al.

[11] 4,441,516

[45] Apr. 10, 1984

[54] DEVICE FOR COUNTING COINS

[75] Inventors: Werner Stadler, Bruchsal; Bernd Petri, Oftersheim, both of Fed. Rep. of Germany

[73] Assignee: Standardwerk Eugen Reis GmbH, Bruchsal, Fed. Rep. of Germany

[21] Appl. No.: 328,495

[22] Filed: Dec. 8, 1981

[30] Foreign Application Priority Data

Dec. 22, 1980 [DE] Fed. Rep. of Germany ..... 3048561

[51] Int. Cl.[3] ..... G07D 9/04

[52] U.S. Cl. ..... 133/8 A; 133/8 E

[58] Field of Search ..... 133/3 F, 8 E, 3 A, 8 R, 133/1 R, 8 A; 53/254; 198/862, 863

[56] References Cited

U.S. PATENT DOCUMENTS 4,173,232 11/1979 Asami et al. ..... 133/8 R

*Primary Examiner*—Stanley H. Tollberg

*Attorney, Agent, or Firm*—Murray Schaffer

[57] ABSTRACT

In a coin counter wherein coins from a centrifugal disc are passed in succession over a guided passageway under contact with a continuous transport belt, the outlet space from the disc, the width of the passageway and the pressure of the transport belt are simultaneously adjusted in accordance with the width and diameter of the coins being counted.

5 Claims, 6 Drawing Figures

DEVICE FOR COUNTING COINS

BACKGROUND OF THE INVENTION

The present invention relates to a device for the counting of coins.

In generally known devices the individual coins are separated for counting by a centrifugal disc, above which a slot is formed which permits the individual coins to be fed onto sequentially to a counter the movement between the slot and counter is taken over by a coin transporter having a define passageway with an endless conveyor belt running above the coins. The passing width of the passageway and the slot width through which the coins are fed are both adjustable jointly according to the diameter and the thickness of the coins by a single adjusting knob.

Such a counting device, which has in practical use proven itself many times has been described in this basic structure in the German unpublished patent specification No. OS 28 48 760. It is evident that this device permits a throughput constituting many times that of the counting machines known up to this time. This is attributable primarily to the compulsory guidance of the coins which is maintained up to the end of the counter by the belt drive associated with the coin transporter. Nevertheless, it is this high throughput which creates another problem, namely in the coin transporter. In operation, the belt drive remains practically unchanged, with regard to its contact pressure, and therefore has to be adjusted always to the smallest occurring coin thickness. This has the result that a desired maximum contact pressure is exceeded with large coins of proportionately large thickness. Extreme differences among the types of coins in a greatly variable running behavior of the entire machine, causes increased wear of the conveyor belt and guide parts, as well as in the creation of noise which is perceived as disturbing in office operations. Previously, this problem could only be eliminated by manual adjustment of the coin transporter, requiring the services of an expert.

This resulted in the task underlying the invention, namely to create for such counting devices an automatic adjustment of the conveyor belt or, respectively, the coin transporter to consistently provide equal contact pressure for all types of coin, and to eliminate the disadvantages still present in this respect in the known devices.

SUMMARY OF THE INVENTION

According to the invention, this task is solved by producing a device for the counting of coins of the type described which includes means for generating a contact pressure by the conveyor belt on the coins passing the counter, which pressure remains constant for each kind of coin. The means to effect this is obtained by making the conveyor belt coin transporter adjustably tiltable about its lateral axis and depending on the respective type of coin (coin thickness) automatically into an associated pre-determined tilting position.

The movement of an adjusting plunger is utilized both for the formation of the feed slot, between the centrifugal disc and a guide block, as well as for the adjustment of the respective tilting position of the belt conveyor of the coin transporter.

The vertical movements of the adjusting plunger, are transmitted by a yoke attached to the adjusting plunger and to an adjusting tappet which acts so as to tilt an adjusting screw arranged off-center in the lower part of the coin transporter.

In order to be able to follow the tilt-action force of the adjusting tappet, the conveyor belt is supported in a tilting bearing at the front side of the chassis.

A spring assembly, the spring of which always exerts its retracting action on the conveyor belt, serves as a counter-mounting against the movements of the adjusting tappet.

The special advantages of the coin counting device pursuant to the invention are found primarily in the fact that as a consequence of only a single manual manipulation, by which the normal adjustment to a certain denomination of coin is made, the correct height of the conveyor belt of the coin transporter is automatically adjusted at the same time. This causes always a certain predetermined constant contact pressure to be exerted on the coins over the entire counting segment, independently of their varying thickness exhibited by the several coin demoninations. In this way, the full throughput is constantly attained, wear is reduced to a minimum, and the running of the entire machine with little noise is assured.

The invention is further explained in the following by means of the drawing representing as an exemplified embodiment a device for the counting of coins.

DESCRIPTION OF THE INVENTION

Figure 1:
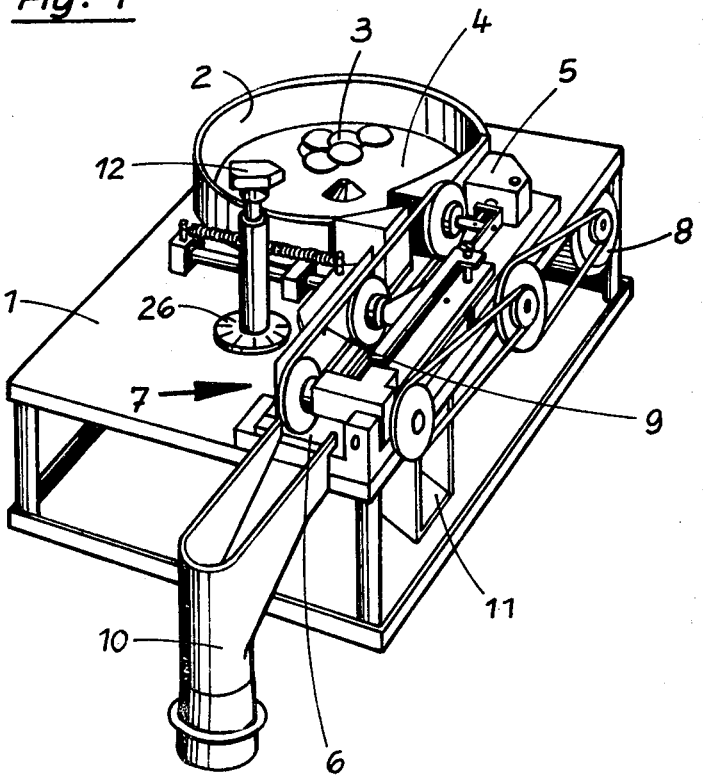
FIG. 1 is a perspective view of a coin counting machine without a housing.
Figure 2:
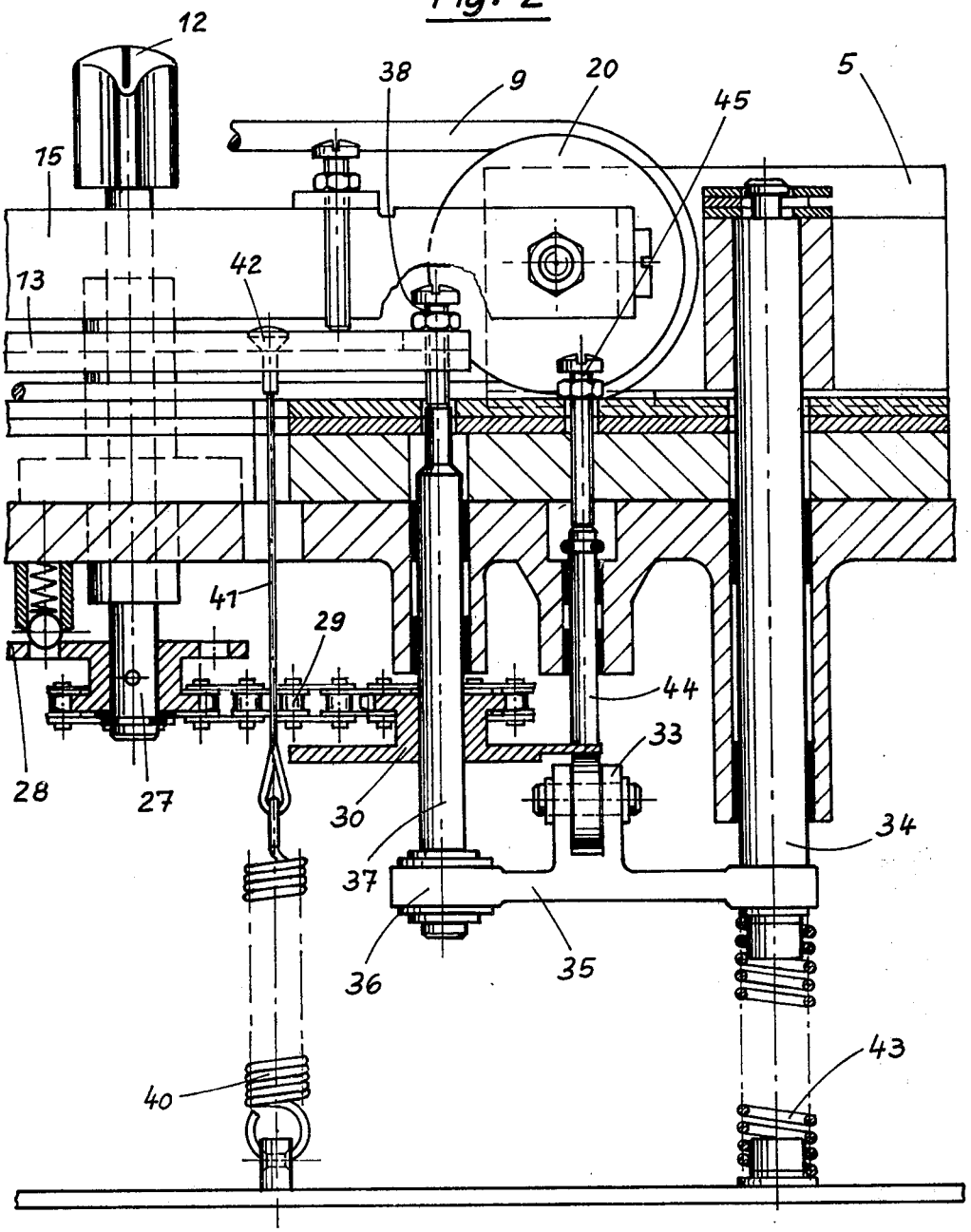
FIG. 2 is a partial sectional view of the adjustment of the diameter and thickness of the coin, as well as the tilting of the coin transporter.
Figure 3:
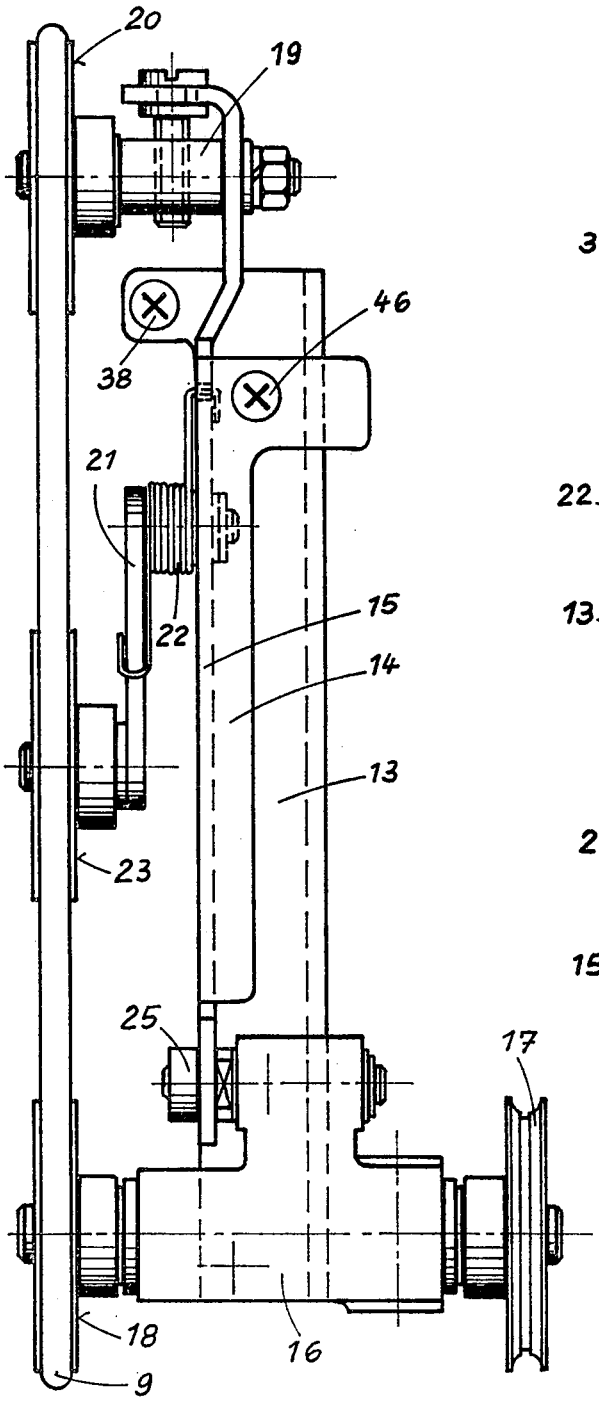
FIG. 3 is a plan view of the coin transporter.
Figure 4:
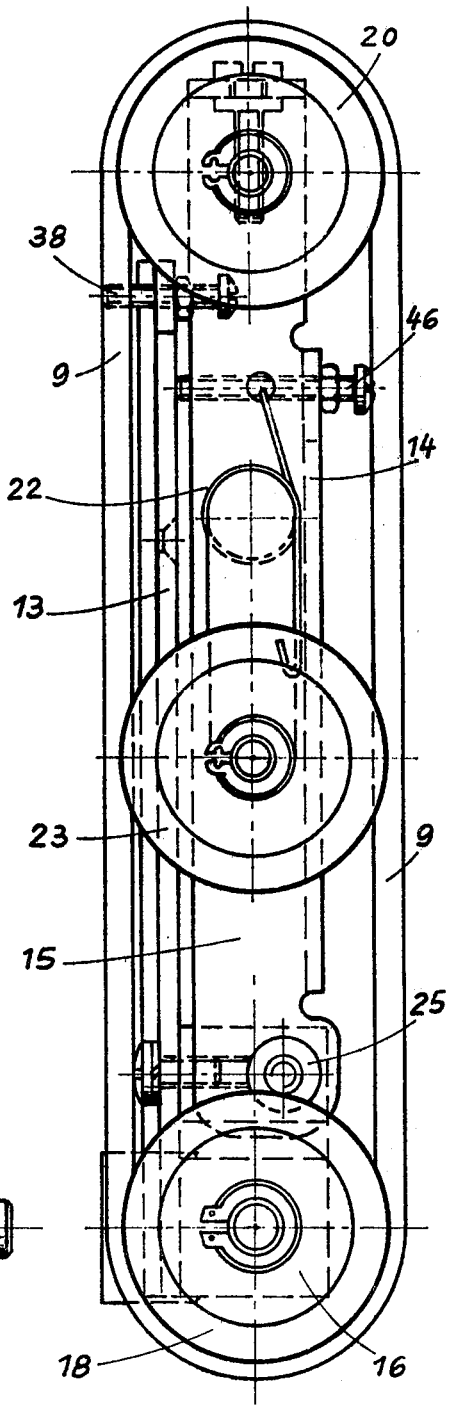
FIG. 4 is a side elevation of the coin transporter shown in FIG. 3.

As seen in FIG. 1 the coin counting machine comprises, as is known, a chassis 1, a partially circular wall container 2 for the accomodation of the coins 3, beneath which is a centrifugal disc 4 for their separation into individuals coins. A guide block 5 for the formation of the feed slot completes the circumference of the container above the centrifugal disc 4. A coin transporter generally depleted by the numeral 7 is provided with a flat passageway arranged between the guide block and a counter 6. A drive motor 8 is mounted within the chassis and is connected to the centrifugal disc 4 and an endless conveyor belt 9 (transport belt) forming part of the coin transporter 7 is located above the passageway. A discharge hopper 10 is located at the downstream end of counter 6 and reject drop 11 is located below it.

The counting machine is set up for a particular coin by means of the adjusting knob 12, as will still be described later on.

The conveyor belt of known coin transporter 7 is located between a lower guide part 13 and an upper guide part 14 with a support bracket 15 at right angles to the latter. The transporter 7 includes a front roller bearing 16 with a drive pulley 17, as well as a driven roller 18, and a rear roller bearing 19 with a roller 20. The belt is entrained over the rollers 18 and 20 and a belt tightener 21. A tension spring 22, as well as a tension roller 23 is provided.

The upper guide part 14 pivots swivable about a transverse axis 25, so that it can be swung upward completely for exposure of the counter 6.

To set the counting machine to process a certain type of coin, only the adjusting knob 12 and the dial 26, which is connected with the latter and bears markings analogous to the various types of coins, are activated. In a manner also known, the shaft 27 extending from the knob 12, has located on its lower end a cam disc 28 to which is integrally formed a tooth wheel which via a connecting chain 29 indexes a step pulley 30. The cam disc is arranged to effect the adjustment of passageway, i.e., the adjustment of the distance between a stationary side rail 31 (FIG. 5) and a movable side rail 32 defines the width of the inlet to the counter 6 according to the diameter of the selected coin 3.

The adjustment for the slot between the centrifugal disc 4 and feed block 5 is transferred from the knob 12 to the step pulley 30 via the chain drive 29 and thereafter transmitted by way of a roller support 33 to a spring biased adjusting plunger 34, which is connected to the feed block 5 which is thereby vertically adjusted relative to the disc 4 to the thickness of the coin 3, i.e., to the correct slot width for the feed of the predetermined coin type into the counting segment 6.

The one-hand adjustment of the counting machine for the selected diameter and the thickness of various coins as so far described is known. However, an adjustment of the coin transporter 7 for the purpose of avoiding the disadvantages described at the introduction is not possible with it and the pressure of the transporter elements on the coins is not provided.

According to present invention, this is remedied by connecting a yoke 35 to the adjusting plunger 34 the yoke 35 carries in addition to the roller support 33 a mounting 36, in which an adjusting tappet 37 is fastened, which participates positively in the vertical movements of the adjusting plunger 34 as triggered by the step pulley 30.

The adjusting tappet 37 acts on an adjusting screw 38 located off-center in the lower guide part of the coin transporter 7 and seated at the free end rear or upstream end of the lower guide part 13. The opposite end (downstream end) of the lower guide part 13 is rigidly connected with the housing of the front roller bearing 16 (FIG. 6) which housing is mounted on the tilt bearing 39.

Figure 6:
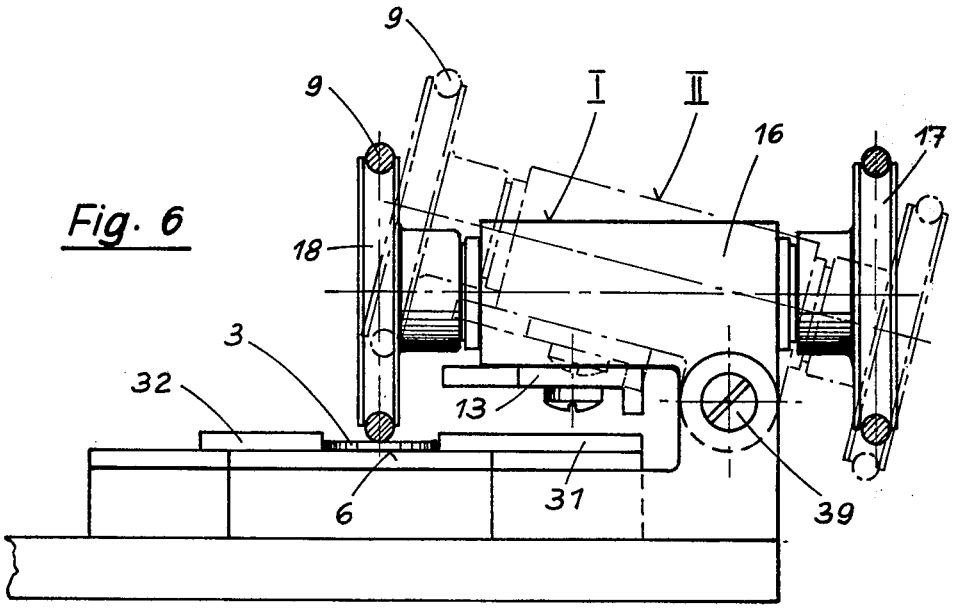
FIG. 6 is a front view of the coin transporter showing the tilt bearing.

The respective position of the adjusting tappet 37 is therefore also determined by way of the step pulley 30 and the yoke 35, depending on the thickness of the coin type to be processed. The greater the thickness of the coin, the higher the adjusting tappet 37 projects upwardly and the more it causes the rear or upstream end of lower guide part 13 to swing upwardly by moving the adjusting screw 38 into an oblique position. As seen in FIG. 6, the movement of the adjusting screw 38 causes the lower guide part 13 to pivot the bearing 16 about the tilt bearing 39 raising the conveyor belt 9, ever so slightly so that the conveyor belt 9 acts in the counting segment 6 with controlled and constant contact pressure on the coins, regardless of the thickness of the coin.

In processing coins which become smaller, ergo with decreasing thickness, the adjusting tappet 37 is lowered or retract, and the adjusting screw 38, the lower part 13, and the conveyor belt 9 follow this movement by resetting of the tilting bearing 39. Thus, the same contact pressure is generated for each type of coin.

A spring assembly consisting of the tension spring 40, a draw cable 41, and an anchorage 42 seated in the lower part 13 serve as a counter-mounting against the movements of the adjusting tappet 37.

The counterforce for the adjusting plunger 34 and the yoke 35 is generated by the compression spring 43 biasing the yoke 35.

An adjusting bolt 44 and an adjusting screw 45 located above the roller block 33 serve as adjustments for the starting position.

Figure 5:
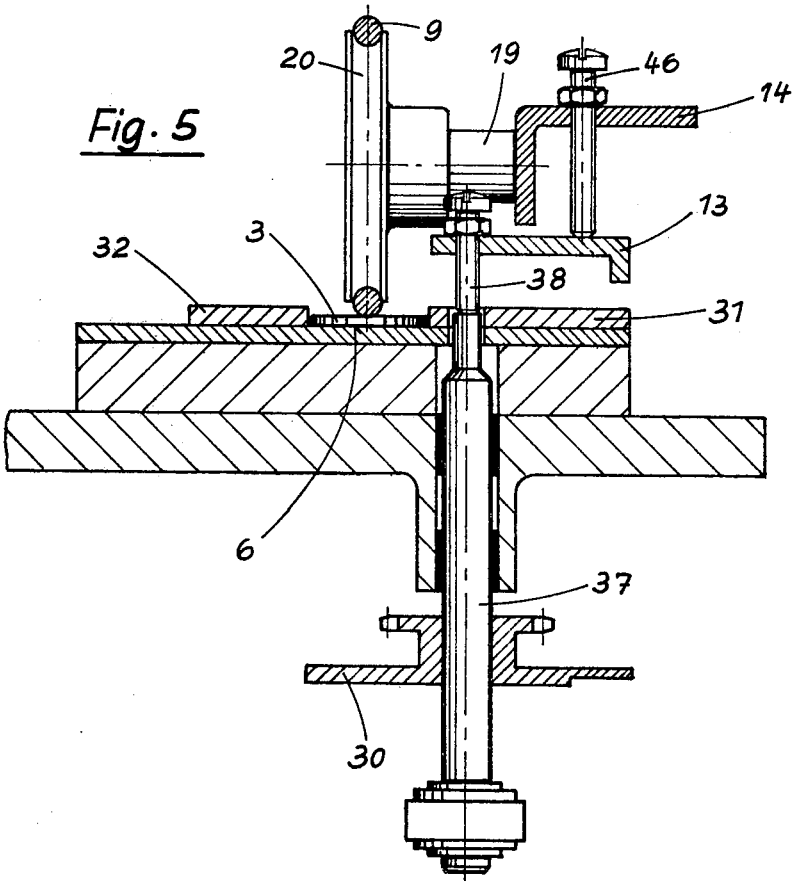
FIG. 5 is a section view taken along line V—V of FIG. 2.

Also shown in FIG. 5 is an adjusting screw 46, by means of which possible production inaccuracies between the lower part 13 and the upper part 14 of the coin transporter 7 can be compensated.

It should be noted once more that with a single actuation of the adjusting knob 12 the guide rails 31, 32 of the counting segment 6 are adjusted to the diameter of a selected type of coin, the guide block 5 is adjusted to the associated thickness of the type of coin, and the coin transporter 7 is adjusted to the predetermined contact pressure of its conveyor belt 9. In this respect FIG. 6 shows how the coin transporter 7 with the conveyor belt 9 is tilted from a lowest position I for smallest (thinnest) coins 3 into a highest position II for largest (thickest) coins.

With the device pursuant to the invention, it is, of course, possible to process in addition to coins also other random disc-shaped objects in a counting process.

We claim:

1. In a coin counting machine having a centrifugal disc surrounded by a circular wall a portion of which is vertically movable to define a slot through which individual coins are permitted to pass into a passageway on to a counter, at least one side of said passageway being movable relative to the other side, adjusting means for simultaneously positioning the movable portion of the vertical containing wall and the side of passageway in accordance with the thickness and diameter of the coins, and an endless belt arranged above said passageway driven to transport said coins through the passageway, the improvement wherein said belt is mounted to a support swingable about a pivot axis extending parallel to its length and laterally offset therefrom, and said adjusting means includes means for simultaneously positioning the belt to depend on the coins in said passageway with a constant pressure regardless of the diameter or thickness of the coins.

2. The coin counting machine according to claim 1 wherein said adjustment means comprises a resiliently biased plunger depending vertically from said movable portion of said container wall, a yoke attached to said plunger and extending laterally therefrom, a tappet secured to said yoke and screw means attached off-center of the pivot axis to said support and means for indexing the position of said plunger along its axis thereby causing said yoke to move said tappet and screw to tilt said support, simultaneous with the adjustment of the movable portion of said container wall.

3. The coin counting machine according to claim 2 wherein the belt support is mounted in a bearing at the front side of the chassis for the machine.

4. The coin counting machine according to claim 2 including means for resiliently biasing said support against the movements of the adjusting tappet.

5. The coin counting machine according to claim 4 wherein said means for biasing said support comprises a spring, a draw cable, and an anchorage.

* * * * *